United States Patent [19]

Harwood et al.

[11] 4,190,746

[45] Feb. 26, 1980

[54] DIAPHRAGM MATERIAL FOR MOVING COIL LOUDSPEAKER, MAY BE LAMINATED OR INTEGRAL WITH SURROUND

[76] Inventors: Hugh D. Harwood, 84 Beechwood Rd., Sanderstead, Surrey; Joseph Y. C. Pao, "Mei-Lan", Coombe Park, Kingston-upon-Thames; David W. Stebbings, 1 Downswood, Reigate, Surrey, England

[21] Appl. No.: 779,221

[22] Filed: Mar. 18, 1977

[30] Foreign Application Priority Data

Mar. 19, 1976 [GB] United Kingdom ..... 11057/76

[51] Int. Cl.[2] ..... H04R 7/12; H04R 7/20; H04R 9/02

[52] U.S. Cl. ..... 179/115.5 R; 179/115.5 ES; 181/167; 181/170; 181/172

[58] Field of Search ..... 179/115.5 R, 115.5 ES, 179/181 R, 181 F; 181/167, 168, 169, 170, 171, 172

[56] References Cited

U.S. PATENT DOCUMENTS

| | | | |
|---|---|---|---|
| 1,538,319 | 5/1925 | Gaumont | 179/115.5 PV |
| 2,922,851 | 1/1960 | Manley | 179/111 R |
| 3,093,207 | 6/1963 | Bozak | 181/168 |
| 3,111,187 | 11/1963 | Barlow | 181/170 |
| 3,313,018 | 4/1967 | Tibbetts | 181/170 |
| 3,345,469 | 10/1967 | Rod | 179/111 R |
| 3,464,514 | 9/1969 | Mochida et al. | 179/115.5 ES |
| 3,898,598 | 8/1975 | Asahi | 179/115.5 ES |
| 3,935,397 | 1/1976 | West | 179/111 R |
| 4,020,296 | 4/1977 | Dahlquist | 179/115.5 PV |

FOREIGN PATENT DOCUMENTS

| | | | |
|---|---|---|---|
| 2233225 | 1/1973 | Fed. Rep. of Germany | 179/115.5 R |
| 2259815 | 6/1973 | Fed. Rep. of Germany | 179/115.5 VC |

*Primary Examiner*—George G. Stellar
*Attorney, Agent, or Firm*—Browdy and Neimark

[57] ABSTRACT

A diaphragm for a moving evil loudspeaker is formed of a material which has a mechanical "0"value of from 7 to 12, a Youngs modulus of from 8.5 to 17.5 $\times$ $10^5$ $KN/M^2$ and a density of from 0.85 to 1.05 g/cc. The diaphragm forming material is preferably formed of polypropylene or a propylene-containing copolymer. The diaphragm may be of cone or dome type and included are moving coil loudspeaker constructions wherein other vibrating elements, particularly spiders and outer cone support rings, are formed of the same type of material as the diaphragm.

9 Claims, 2 Drawing Figures

Figure 1:
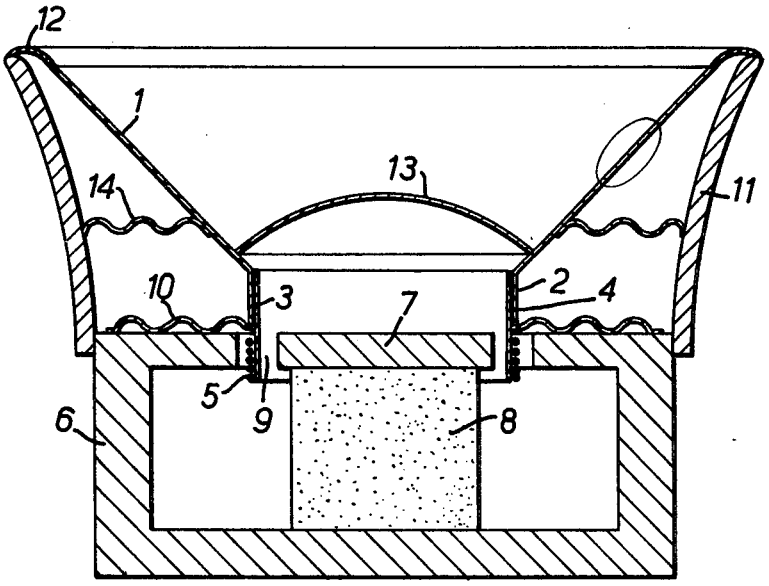
Figure 1A:
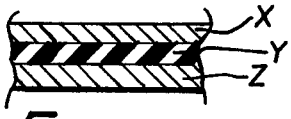
Figure 1B:
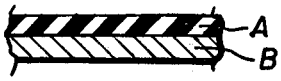

DIAPHRAGM MATERIAL FOR MOVING COIL LOUDSPEAKER, MAY BE LAMINATED OR INTEGRAL WITH SURROUND

This invention relates to diaphragms for moving coil loudspeakers, otherwise known as moving coil electro-acoustic transducers.

The quality of reproduction of program by a loudspeaker is a function of the axial response/frequency characteristic, of the directional properties and above all of a factor known as coloration. For the best reproduction to be obtained, it is necessary for each of these factors which are not necessarily completely independent, to be correct. Thus, to some extent, it is possible to reduce the effect of coloration by effecting changes in the axial response/frequency characteristic; it is also possible to remedy deficiencies in the directional properties by changes in the axial response/frequency characteristic. In neither case must such alterations in the axial response/frequency characteristic be taken too far since this characteristic itself will become unsatisfactory. Moreover, a suitable balance of the aforesaid characteristics for one type of program will not necessarily be optimum for another. For these reasons, in loudspeakers of the highest quality, the frequency band is split into two, or even three, sections, employing different units for the different bands with appropriate frequency dividing networks plying each unit. Thus, with lower frequency units, loudspeaker diaphragms of flared form, that is including forms ranging from conical through hyperbolic section may be employed, these generally being termed "cones". For high frequency bands, so-called tweeter domes are employed. In this way, each unit can be operated over its optimum band width with a corresponding improvement in the overall quality.

Such a design does, however, involve appreciable expense and manufacturing effort since, in addition to the cost of two or more loudspeaker units, there must be added that of the necessary frequency-dividing networks and the work involved in ensuring that the sensitivities of each of the units corresponds to a particular design figure. For these reasons, in cheaper loudspeakers it is generally preferred to use a single unit to cover the whole frequency range, this involving, of course, the greater danger that the sound will be colored, that the loudspeaker will be too directional and that the axial response/frequency characteristic will be too restricted.

Hitherto, diaphragms for loudspeakers have been made of a wide variety of materials having varied physical characteristics. Thus, for example, it is known to use polystyrene, polyvinylchloride, polymethacrylamide, cellulose acetate, acrylic resins, polyacrylonitrile resin, polyacrylamide, phenolic resins, unsaturated polyester resins, polyoxy resins and polyurethane resins in British patent specification No. 1,384,716. British patent specification No. 1,271,539 discloses loudspeaker diaphragms formed of cloth having a foamed synthetic resin fused thereto. British patent specification No. 1,186,722 discloses flat plate-type loudspeakers whose diaphragms may be formed of polystyrene, polyvinylchloride, polyethylene, polyamide, polyurethane, acrylonitrile-butadiene-styrene resin which, as in the case of British patent specification No. 1,384,716, is foamed. Moreover, British patent specification No. 1,174,911 discloses loudspeaker diaphragms formed of metal, specifically titanium. None of the aforesaid plastics and metal materials however provide the desired quality of reproduction of program as aforesaid, particularly over the whole frequency range.

It is an object of this invention to provide a diaphragm for a loudspeaker which can be used satisfactorily over the whole frequency range.

It is another object of this invention to provide a synthetic plastics material for use in the construction of moving coil type loudspeakers, in the diaphragm and in other parts thereof, to ensure that the loudspeaker may be used satisfactorily over the whole frequency range.

According to one aspect of the present invention, there is provided a diaphragm for a moving coil loudspeaker, the diaphragm being of conic section, or exponential section or having a cross-section over the major part thereof which is of conic section or of exponential section form, in which diaphragm, the diaphragm forming material has a mechanical "Q" value of from 7 to 12, a Young's modulus of from 8.5 to $17.5\times10^5$ KN/M$^2$ and a density of 0.85 to 1.05 g/cc.

According to a second aspect of the invention, there is provided a moving coil loudspeaker having a diaphragm formed of a material having the characteristics as aforesaid.

It has now been found that by suitable selection of the physical properties of materials used in the construction of diaphragms for moving coil loudspeakers that it is possible to achieve satisfactory behavior over the entire frequency range when employing a single unit. The materials which have hitherto been employed in the construction of loudspeaker diaphragms fail to meet these requirements.

A particularly preferred material having the aforesaid physical characteristics rendering it suitable for use in the manufacture of diaphragms for moving coil loudspeakers is polypropylene. Propylene may be used as such or in copolymers with minor proportions of olefinically unsaturated copolymerizable monomers, for example ethylene, provided that the physical characteristics of the copolymer do not fall outside the aforesaid ranges. It is particularly surprising that polypropylene should provide the required physical characteristics whereas, for example, polyethylenes which have hitherto been employed have generally been unsatisfactory. That is not to say that all polyethylenes are unsatisfactory. As will be apparent from the Table which follows, commercially available medium impact polyethylene may be utilized in the production of diaphragms according to this invention, although low impact and high impact polyethylenes are unsatisfactory.

In addition to forming the diaphragms of plastics material as such, the plastics material may be coated on one or both sides with certain plastics, metallic and ceramic materials, provided that the aforesaid physical characteristics remain within the specified ranges therefor. In this way, variations in the quality of reproduction of program may be achieved. Thus, it is possible for a polypropylene copolymer to be given a thin coating (say 38 microns) of low density polyethylene or of highly atactic polypropylene and be satisfactory for use in loudspeakers. Propylene homopolymer and copolymer diaphragms may also constitute the filling of sandwiches between thin covering layers of light metals, for example aluminum, titanium or beryllium, or other plastics materials, for example polystyrene, polyvinylchloride, acrylonitrile-butadiene-styrene terpolymer and polyethylene or even ceramic materials such as those of the barium titanate group.

It is not possible with any certainty to advance a reason as to why, for example, polypropylene should provide diaphragms having the desired acoustical properties where other plastics materials with similar physical properties are not satisfactory. It is possible, but by no means certain, that the crystallites in polypropylene are randomly oriented where, for example, polyethylene has a structure which under a high acceleration produced by a voice coil causes a sliding of molecules over each other in accordance with the stress imparted thereto, thereby producing acoustic distortion.

It will be appreciated that coated and sandwich-form cones may be produced by a variety of techniques depending upon the materials involved. Thus, when metal-covered cones are to be produced, the metal may be applied to the "filling" material either as a preformed foil or by a vapor deposition method, an adhesive, for example a polyvinyl acetate-base adhesive, being employed in the former case to achieve the required adhesion. When plastics materials are to be joined together, then thermal welding methods may be employed.

There are now set out in tabular form the physical properties of a variety of plastics products which have been employed in the manufacture of loudspeaker diaphragms, from which it can be seen which products have the desired physical properties according to the present invention.

TABLE

| | | Physical Characteristics | | |
|---|---|---|---|---|
| +Sample | Material | Mechanical Q | Youngs Modulus ($KN/M^2$) | Density (g/cc) |
| A | Low impact polyethylene | 12 | $6.75 \times 10^5$ | 0.94 |
| B | Medium impact polyethylene | 10.5 | $10.5 \times 10^5$ | 0.94 |
| C | High impact polyethylene | 17 | $19.75 \times 10^5$ | 0.95 |
| D1 | Polystyrene* | 31 | $19 \times 10^5$ | 0.99 |
| D2 | Polystyrene* with thin coat of Plastiflex++ | 21 | " | 1.00 |
| D3 | Polystyrene* with thick coat of Plastiflex on each side | 9 | " | 1.30 |
| E | Polypropylene | 11.0 | $15.5 \times 10^5$ | 0.89 |
| F | Propylene/ethylene copolymer (Shorkofilm-product of British Celathene) | 11.0 | $11.5 \times 10^5$ | 0.89 |
| G | As F with coating (38μ) of LDPE** | 10.0 | $9.75 \times 10^5$ | 0.92 |
| H | As F with coating (30μ) of MDPE*** | 14 | $13.5 \times 10^5$ | 0.90 |
| J | As F with highly atactic polypropylene coating (30μ) | 8.5 | $10 \times 10^5$ | 0.91 |

*Product commercially available under Registered Trade Mark "Bextrene"
**Low density polyethylene
***Medium density polyethylene
+Diaphragm thickness was 0.015" plus thickness of any coating as indicated
++Commercially available form of polyvinyl acetate The present invention is applicable to moving coil loudspeaker diaphragms of various shapes as already discussed above. In particular, it is applicable to diaphragms of cone-form and dome-form. The directivity and the axial response/frequency characteristics of a loudspeaker unit are a function of the shape or contour of the diaphragm, as well as the material of which the diaphragm is made. When a single unit is to be employed to cover the entire frequency range, it is preferred to use a diaphragm according to this invention shaped to a hyperbolic form. Under these conditions, the wave motion spreads out from a voice coil along the diaphragm at such a velocity that the effective size of the acoustic source appears to be considerably smaller as the frequency rises even though the whole diaphragm is taking part in the radiation, the combination of mechanical damping in the material and in the surround, ensuring a low standing wave ratio. The effective mechanical impedance sensed by the voice coil therefore also becomes less as the frequency rises and in consequence the axial response/frequency characteristic is maintained up to a high frequency.

Although speaker units having a single loudspeaker unit containing a diaphragm according to this invention perform particularly well, for the best audio characteristics to be achieved, it is nevertheless preferred that a loudspeaker comprise two or three units according to this invention covering different frequency bands. Whilst this is obviously a more expensive operation, it has been found that the quality of reproduction then obtained is superior to that obtained with multiple-unit loudspeakers comprising diaphragms formed of materials not in accordance with those specified for use in the present invention.

The quality of reproduction which can be obtained with diaphragms according to this invention, especially when a number thereof are employed in a loudspeaker, is such that minor distortions arising out of other features of the loudspeaker construction and which may be of no significance in relation to coloration achieved as a result of the use of other materials in the construction of the diaphragms themselves, becomes relatively important and noticable to the trained ear. Plastics materials are also usually employed in loudspeaker units constructions in the so called outer cone support ring (cones only) and in the so called spiders or centering members (cones and domes). According to a further aspect of this invention, it is preferred that, where relevant, these constructional members also be formed of plastics material having the physical characteristics as aforesaid. Again it is preferred that they be formed of polypropylene or propylene-containing copolymers as aforesaid.

Figure 2:
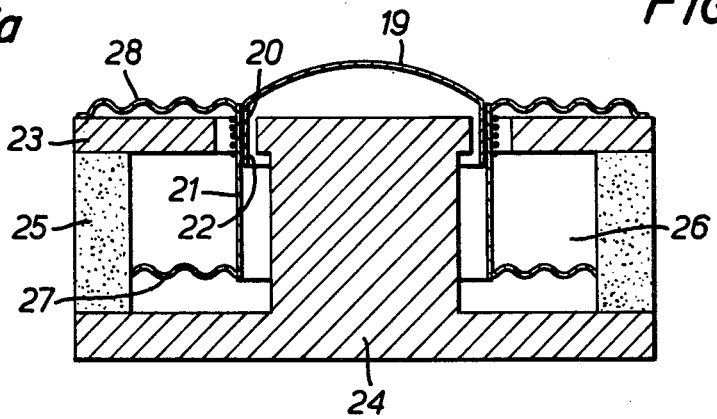

For a better understanding of the invention, and to show how the same may be carried into effect, reference will now be made, by way of example only, to the accompanying drawings, in which, FIG. 1 is a schematic section through one form of moving coil loudspeaker embodying this invention with inserts showing, on enlarged scale, alternative variants of the diaphragm usable in the loudspeaker of FIG. 1; and FIG. 2 is a schematic sectional view of an alternative form of moving coil loudspeaker embodying this invention.

Referring to FIG. 1 of the drawings, the loudspeaker is of low frequency type and comprises a diaphragm 1 of truncated conical form shown schematically as a simple conical form but in practice of hyperbolic form, terminating in a section 2 of cylindrical form bonded to a voice coil former 3 mounted on a thin layer 4 of adhesive. The diaphragm 1 is formed of polypropylene in accordance with the present invention. As shown in the inserts of FIG. 1, the diaphragm 1 may take the form of laminations XYZ or AB. In laminate XYZ the polypropylene layer Y is laminated between two thin applied coatings X and Z of metal, for example aluminum or titanium. In laminate AB, this sandwich structure is replaced by a two layer structure comprising the layer A of polypropylene and a coating B formed of a second plastic material which is low or medium density polyethylene or a highly elastic polypropylene coating. The voice coil former carries a voice coil 5 formed of a number of turns of wire and located in the air gap between two pole pieces 6 and 7 formed, for example, of mild steel. Separating the pole pieces is a magnet 8 which may be formed of ferrite. In the construction shown, the magnet is of the slug type surmounted by the pole piece 7 and set on the cylindrical pole piece 6. The voice coil is set in the cylindrical air gap 9 so as to provide a clearance of about 0.01 inches with respect to each of the pole pieces. In order that the voice coil former and hence the diaphragm should vibrate, in use, in a strictly vertical direction, a spider 10 also formed of polypropylene is employed to connect the voice coil former to the pole piece 6. At its upper end, the diaphragm 1 is connected to a supporting basket 11 by means of an outer cone support ring 12 which like the diaphragm 1 is formed of polypropylene. The support ring 12 is adhesively bonded to the diaphragm 1 and the basket 11. At its lower end, the supporting basket which has a metal framework construction is secured to the pole piece 6. To prevent dust from entering the air gap 9, a dust cap 13 which is preferably formed of polypropylene spans the interior of the diaphragm in a lower region thereof. A second spider 14 also preferably formed of polypropylene, is employed to connect the diaphragm 1 to positions around the supporting basket 11 and with the spider 10 provide a parallelogram of forces assisting in the stabilization of the diaphragm and the voice coil former 3.

Referring next to FIG. 2, there is shown a loudspeaker of the tweeter type. The loudspeaker comprises a dome-shaped diaphragm 19 formed of polypropylene and having a section 20 of cylindrical form bonded to a voice coil former 21. The voice coil former and section 20 of the diaphragm 19 are positioned in an air gap 22 between two pole pieces 23 and 24 between which is located a ring magnet 25. Alternatively, the magnetic circuit may take the form shown in FIG. 1. The voice coil former 21 extends down into an annular volume 26 and is connected to the ring magnet 25 by means of a spider 27 formed of polypropylene. At an upper portion thereof, the voice coil former 21 is connected to the pole piece 23 by means of another spider 28 formed of polypropylene.

It should be appreciated that in the accompanying drawing, many features are shown schematically and that for purposes of ease of representation scales are somewhat distorted. This applies particularly to dimensions of the air gap and the gap between the diaphragm and the voice coil former.

We claim:

1. A diaphragm for a moving coil loudspeaker, the diaphragm being of conic section, of exponential section or having a cross-section over the major part thereof which is of conic section or of exponential section form, which diaphragm, in order to impart internal damping characteristics thereto, is formed of, or includes a layer of, a diaphragm-forming material selected from the group consisting of polypropylene, polyethylene and ethylene-propylene copolymers, the ethylene being present in copolymerized form in minor amount with respect to the propylene, said material having a mechanical "Q" value of from 7 to 12, a Young's modulus of from 8.5 to $17.5\times10^5$ KN/M$^2$ and a density of from 0.85 to 1.05 g/cc.

2. A diaphragm as claimed in claim 1, which has a sandwich structure, the diaphragm-forming material being covered on both sides with a material selected from the group consisting of plastics, metal and ceramic material.

3. A diaphragm as claimed in claim 2, wherein the plastics material is selected from the group consisting of polystyrene, polyvinylchloride, acrylonitrile-butadiene-styrene terpolymer and polyethylene.

4. A diaphragm as claimed in claim 2, wherein the metal material is selected from the group consisting of titanium, aluminum and beryllium.

5. A diaphragm for a moving coil loudspeaker, the diaphragm being of conic section, of exponential section or having a cross-section over the major part thereof which is of conic section or of exponential section form, which diaphragm incorporates, in order to impart internal damping characteristics thereto, a layer of a material selected from the group consisting of polypropylene, polyethylene and ethylene-propylene copolymers, and a coating of another plastics material thereon, the ethylene being present in said copolymer in copolymerized form in minor amount with respect to the propylene, the material of said layer having a mechanical "Q" value of from 7 to 12, a Young's modulus of from 8.5 to $17.5\times10^5$ KN/M$^2$ and a density of from 0.85 to 1.05 g/cc.

6. A diaphragm as claimed in claim 5, wherein the plastics material is selected from the group consisting of low density polyethylene, medium density polyethylene and atactic polypropylene.

7. A moving-coil-type loudspeaker which comprises a diaphragm, the diaphragm being of conic section, of exponential section or having a cross-section over the major part thereof which is of conic section or of exponential section form, which diaphragm, in order to impart internal damping characteristics thereto, is formed of, or includes a layer of, a diaphragm-forming material selected from the group consisting of polypropylene, polyethylene and ethylene-propylene copolymers, the ethylene being present in copolymerized form in minor amount with respect to the propylene, said material having a mechanical "Q" value of from 7 to 12, a Young's modulus of from 8.5 to $17.5\times10^5$ KN/M$^2$ and a density from 0.85 to 1.05 g/cc.

8. A loudspeaker as claimed in claim 7, which has said cone-type diaphragm mounted in a supporting basket to which said diaphragm is connected by means of an outer cone support ring which is formed of a plastic material, the plastics material being selected from the group consisting of polypropylene, polyethylene and ethylene-propylene copolymers, the ethylene being present in copolymerized form in minor amount with respect to the propylene, the plastics material having a mechanical "Q" value of from 7 to 12, a Young's modulus of from 8.5 to $17.5\times10^5$ KN/M$^2$ and a density of from 0.85 to 1.05 g/cc.

9. A loudspeaker as claimed in claim 7, which comprises at least one spider formed of a plastics material, the plastics material being selected from the group consisting of polypropylene, polyethylene and ethylene-propylene copolymers, the ethylene being present in copolymerized form in minor amount with respect to the propylene, said plastics material having a mechanical "Q" value of from 7 to 12, a Young's modulus of from 8.5 to $17.5\times10^5$ KN/M$^2$ and a density of from 0.85 to 1.05 g/cc.

* * * * *